US006129218A

United States Patent [19]

Henry et al.

[11] Patent Number: 6,129,218

[45] Date of Patent: Oct. 10, 2000

[54] MERCHANDISE DISPLAY SYSTEM

[75] Inventors: Eric F. Henry, Rutherford, N.J.; Michael Senetra, Lake Grove, N.Y.

[73] Assignee: Target Brands, Inc., Minneapolis, Minn.

[21] Appl. No.: 09/248,593

[22] Filed: Feb. 11, 1999

Related U.S. Application Data

[63] Continuation-in-part of application No. 09/075,647, May 11, 1998, abandoned.

[51] Int. Cl.[7] ..... A47F 1/12; B65G 59/00

[52] U.S. Cl. ..... 211/59.3; 221/279

[58] Field of Search ..... 211/59.3, 184, 211/279

[56] References Cited

U.S. PATENT DOCUMENTS

| | | | |
|---|---|---|---|
| 4,463,854 | 8/1984 | MacKenzie | 211/184 X |
| 4,742,936 | 5/1988 | Rein | 211/59.3 X |
| 4,830,201 | 5/1989 | Breslow | 211/59.3 X |
| 5,027,927 | 7/1991 | Skalski | 211/59.3 |
| 5,190,186 | 3/1993 | Yablans et al. | 221/279 X |
| 5,413,229 | 5/1995 | Zuberbuhler et al. | 211/59.3 |
| 5,427,255 | 6/1995 | Nook | 211/184 X |
| 5,464,105 | 11/1995 | Mandeltort | 211/184 |
| 5,613,621 | 3/1997 | Gervasi | 221/279 |
| 5,638,963 | 6/1997 | Finnelly et al. | 21/59.3 |
| 5,695,163 | 12/1997 | Tayar | 248/243 |

*Primary Examiner*—Daniel P. Stodola
*Assistant Examiner*—Erica B. Harris
*Attorney, Agent, or Firm*—Jeffer, Mangels, Butler & Marmaro LLP

[57] ABSTRACT

A surface mounted display device for serially stacked products, the display device including a first support member, a second support member and at least one divider member removably mounted between the two support members. The divider member has a web to which a pusher plate is movably attached. A guide arrangement is provided on the web for guiding the pusher plate. A spring biases the pusher plate toward one end of the display. Products are stacked between the pusher plate and the first support. When a product is removed, the pusher plate, being biased toward the first support member, advances the next product to the front of the display.

40 Claims, 12 Drawing Sheets

FIG.6
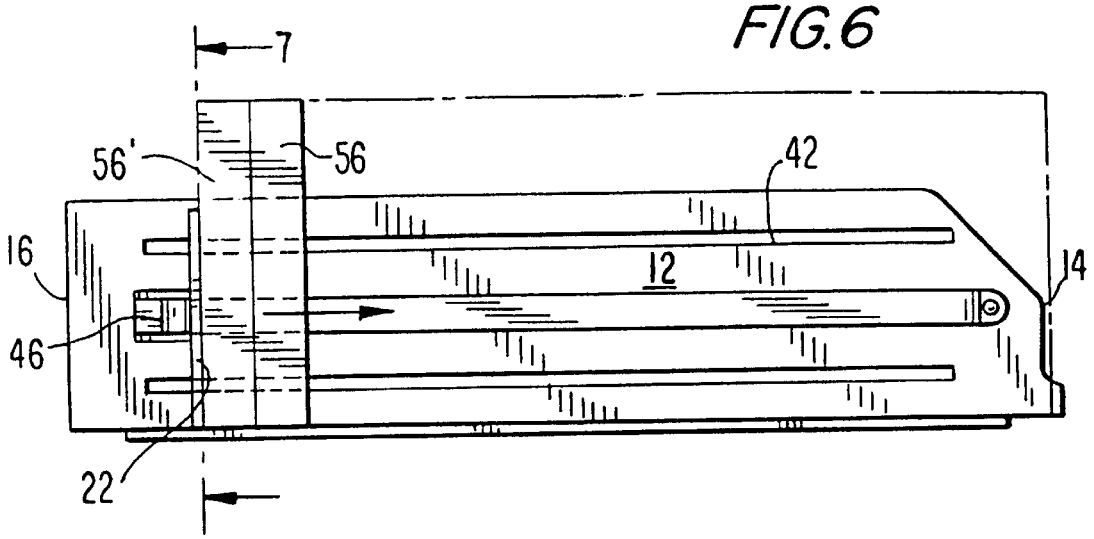
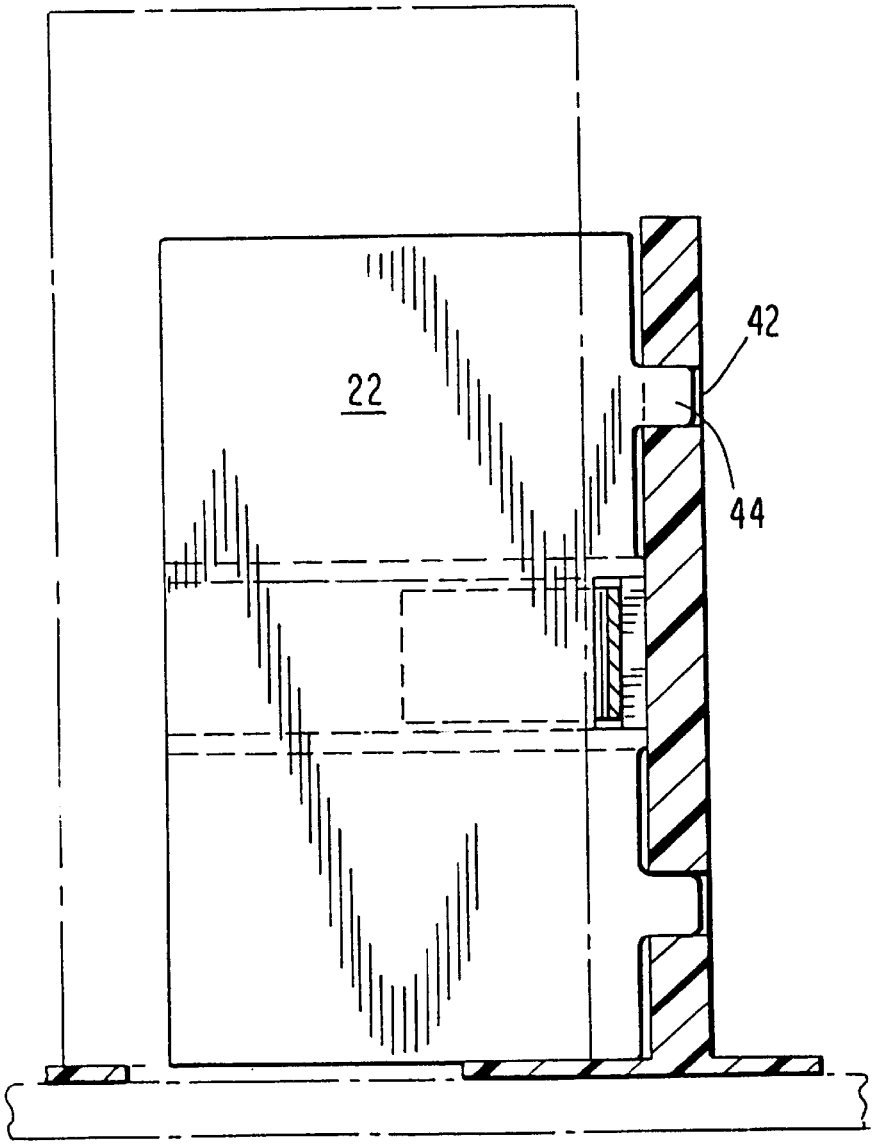
FIG.7

13
18
84
86
48
50
82
14
30"

FIG.15
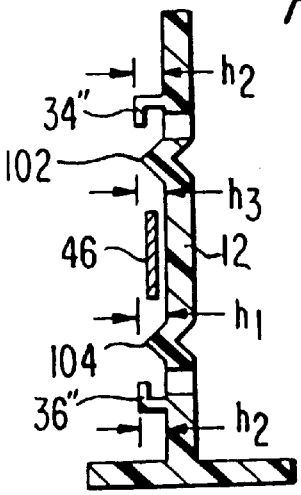
FIG.16
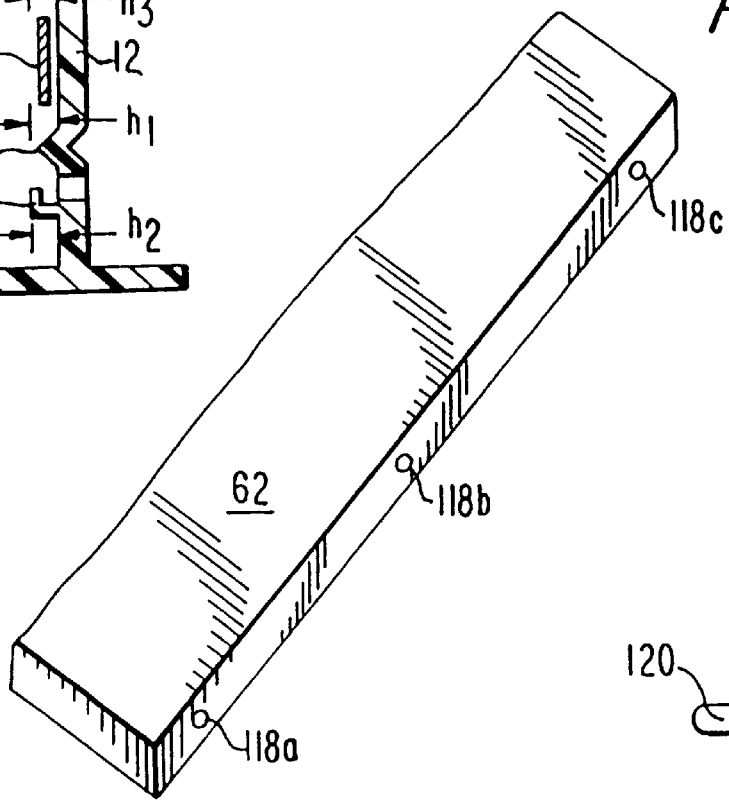
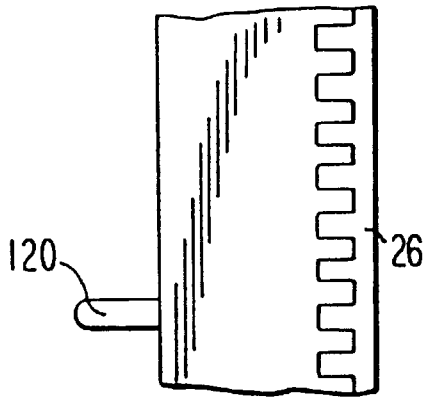
FIG.17A
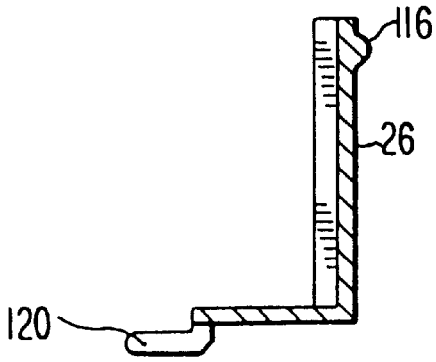
FIG.17B

FIG. 18
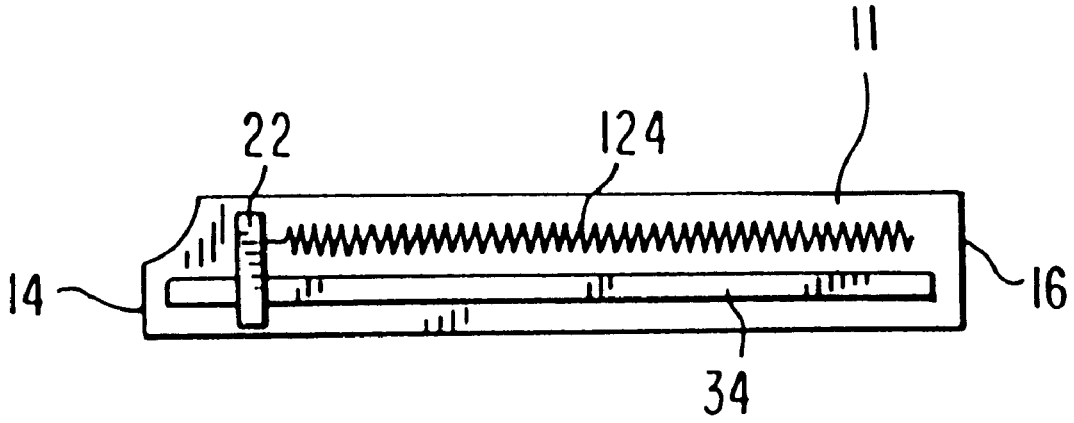
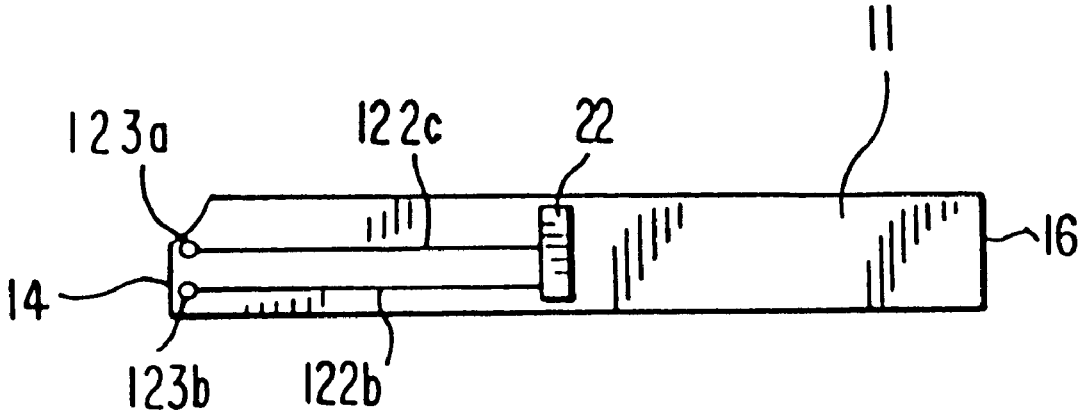
FIG. 19

MERCHANDISE DISPLAY SYSTEM

RELATED APPLICATION INFORMATION

This application is a Continuation-in-Part of U.S. patent application Ser. No. 09/075,647 filed May 11, 1998, now abandoned.

BACKGROUND OF THE INVENTION

1. Field of the Invention

The present invention relates to a device for displaying serially stacked products, and more particularly to a device which automatically advances the products to one end of the display by means of at least one divider member with a spring-loaded pusher plate movably attached thereto.

2. Description of the Related Art

Merchandising practice requires that retail products be displayed in a well organized manner, and that merchandise be readily accessible and attractively displayed to the consumer. It is desirable that products stacked on a shelf, be squarely aligned one behind the other, be oriented to face the consumer, be rotated to maintain freshness and be positioned so that the products are towards the front of the shelf. It is also desirable to display the products attractively thereby encouraging consumers to examine and purchase the merchandise.

In a typical wholesale or retail establishment serially stacked products are usually placed upon a shelf for display. Setting up and maintaining the display is usually done manually. The products must be carefully organized, rotated, stacked and aligned. The removal of merchandise by the consumer leaves a space at the front of the shelf with the remaining products towards the rear being difficult to view and access. Furthermore, the consumer is likely to move the products around so that the items are no longer neat and orderly but instead are haphazardly arranged, as a result of which many items no longer have the product name facing the front of the display. The merchandiser must continually inspect and rearrange the displayed products, which is time consuming and costly. It is therefore advantageous to have a display device which maintains stacked products in a neat and organized manner while automatically moving the merchandise toward the front as products are removed.

Although there is prior art teaching devices that automatically advance a stacked product, each has significant shortcomings. For example, U.S. Pat. No. 5,012,936 depicts a display device with a sliding tray or bin having a pusher plate biased toward the front by a flat coil spring. This device has a tray of fixed dimensions which is not adjustable to accommodate products of different sizes. The tray device also has a complex construction which makes it expensive to manufacture.

U.S. Pat. No. 4,729,481, teaches a device having a belt or a roll biased by a coiled spring. Although this device is adjustable, separate dividers are required resulting in additional parts and labor costs.

U.S. Pat. No. 4,300,693, teaches a device having a spring biased pusher plate mounted on a track. This device has the disadvantage of not being adjustable to accommodate differently sized products. Additionally, U.S. Pat. No. 3,308,961, teaches an adjustable display device which utilizes a spring biased pusher plate mounted to runners. This device does not have dividers and therefore the merchandise can be easily misaligned.

SUMMARY OF THE INVENTION

Accordingly, it is an object of the present invention to provide a display device which maintains stacked products in a neat and organized manner, automatically moves merchandise toward the front as products are removed, is attractive, easy to setup and maintain, and adjustable to accommodate differently sized products.

Pursuant to this object, the inventive display device includes at least one divider member removably supported by a first support member and a second support member. The support members can be attached to a shelf-like surface by various types of connectors known in the art, such as screws, clips or pins.

The divider member has a web to which a pusher plate is slidably attached. The pusher plate is biased toward the first support member by a resilient means such as a flat coil spring. The divider member also has a flange which acts as a track to facilitate movement of the products. Products are stacked between the pusher plate and the first support member and are disposed toward the first support member by the pusher plate and the flat coil spring arrangement so that removing a product from the display automatically advances the next product toward the first support member.

The display device can be formed of various materials such as plastic, metal or wood. The divider member and support members can have different shapes and colors so as to be attractive and so as to accommodate various types of products. The supports can be permanently or removably attached to any suitable flat surface, such as a shelf or counter top. The surface can also be arranged as an integral part of the display device enabling the display device to be self-contained contained and easily relocated. In accordance with one embodiment of the present invention, pins are disposed at the bottom ends of the support members. The pins are removably insertable into openings such as are typically configured in shelves of merchandise gondolas.

The first and second support members have at least one depression and at least one support slot in which the divider member is removably supported, so that the divider member can be placed in any number of positions. Also, the display device can have a plurality of divider members so that products are displayed in a side by side arrangement. Furthermore, a plurality of devices can be combined to form a larger display system. In another embodiment, the support members have a plurality of slots and depressions.

In accordance with another embodiment of the present invention, the first and second support members can be attached to an existing shelf unit and the at least one divider member is removably supported by the support members. The flange is provided at a bottom edge of the web, and the pusher plate is slidably attached, perpendicular to a side of the web. A first end of the web has a tab which is removably inserted into the depression configured in the first support member and a second end of the web is removably inserted into the support slot configured in the second support.

In yet another embodiment of the present invention, the first end of the web has a hook. A lip is disposed at the top end of the first support so that when the web is removably inserted, the hook removably engages the lip.

A first guide rail is provided on the side of the web and a second guide rail is provided on the side of the flange proximal the first guide rail. It is also possible to provide the second guide rail on the side of the web. The guide rails extend between positions proximal the first end and a second end of the web. The guide rails are also parallel to one another. First and second notches in the pusher plate correspond to the respective guide rails so that the notches fit over the guide rails. The guide rails can be replaced with guide slots configured in the web. In this case, the pusher plate is provided with tabs arranged so as to be slidably engaged in the guide slots. A flat coil spring is connected between the pusher plate and the web thereby biasing the pusher plate to the first end of the web. A corresponding third notch in the pusher plate is provided to allow the flat coil spring to pass through the pusher plate. Another feature of the present invention is that products rest on the flange rather than directly on the shelf surface, the flange having less contact area and therefore less frictional resistive force than the shelf surface. In a typical application having a plurality of dividers, the product rests on two flanges, one flange of each of two adjacent dividers.

A taper near the first end of the web facilitates removal of the front-most product. When a product is removed, the coil spring biases the pusher plate toward the first end, thereby moving the next product toward the first end, the pusher plate being restrained by the guide rails.

Pursuant to a further embodiment of the invention, the first guide rail is provided at an upper edge of the web, the first notch being reconfigured to slidably engage the first guide rail.

In yet a further embodiment of the invention, at least one bevel is added to the web for providing additional support to the product being pushed by the pusher plate. The divider is provided with an engagement flange for engaging the second support member and securing the second support member to the first support member via the divider. The second support member optionally includes a lip for engaging a corresponding notch in the engagement flange of the divider.

In a further embodiment, a stopper is added to the web of the divider in an area near the rear of the divider to prevent the pusher plate from being disengaged from the guide rails by over extension in the rearward direction. The stopper can be a raised pin in the path of the pusher plate, or a raised rib positioned perpendicular to and in the path of the pusher plate.

In yet another embodiment, the second support member is provided with engagement hooks extending outward therefrom and adapted to engage corresponding holes in a rear edge of the shelf on which the display is situated.

Other objects and features of the present invention will become apparent from the following detailed description considered in conjunction with the accompanying drawings. It is to be understood, however, that the drawings are designed solely for the purposes of illustration and not as definition of the limits of the invention, for which reference should be made to the appended claims.

The various features of novelty which characterize the invention are pointed out with particularity in the claims annexed to and forming a part of the disclosure. For a better understanding of the invention, its operating advantages, and specific objects attained by its use, reference should be made to the drawings and descriptive matter in which there are illustrated and described preferred embodiments of the invention.

BRIEF DESCRIPTION OF THE DRAWINGS

FIG. 6 is an elevational view of the divider member of a second embodiment of the invention;

FIG. 7 is a sectional view of the pusher plate taken along lines 7—7 of FIG. 6;

FIG. 15 is a cross-sectional view of the divider member as taken along lines 15—15 of FIG. 14;

FIG. 16 is a partial perspective view of the rear of a shelf for mounting the merchandise display system according to an embodiment of the invention;

FIG. 17*a* is a top view of the second support member according to another embodiment of the invention;

FIG. 17*b* is a side sectional view of the second support member of FIG. 17*a;*

FIG. 18 is a schematic representation of the spring device according to another embodiment of the invention; and FIG. 19 is a schematic representation of the spring device according to yet another embodiment of the invention.

DETAILED DESCRIPTION OF PREFERRED EMBODIMENTS

Figure 1:
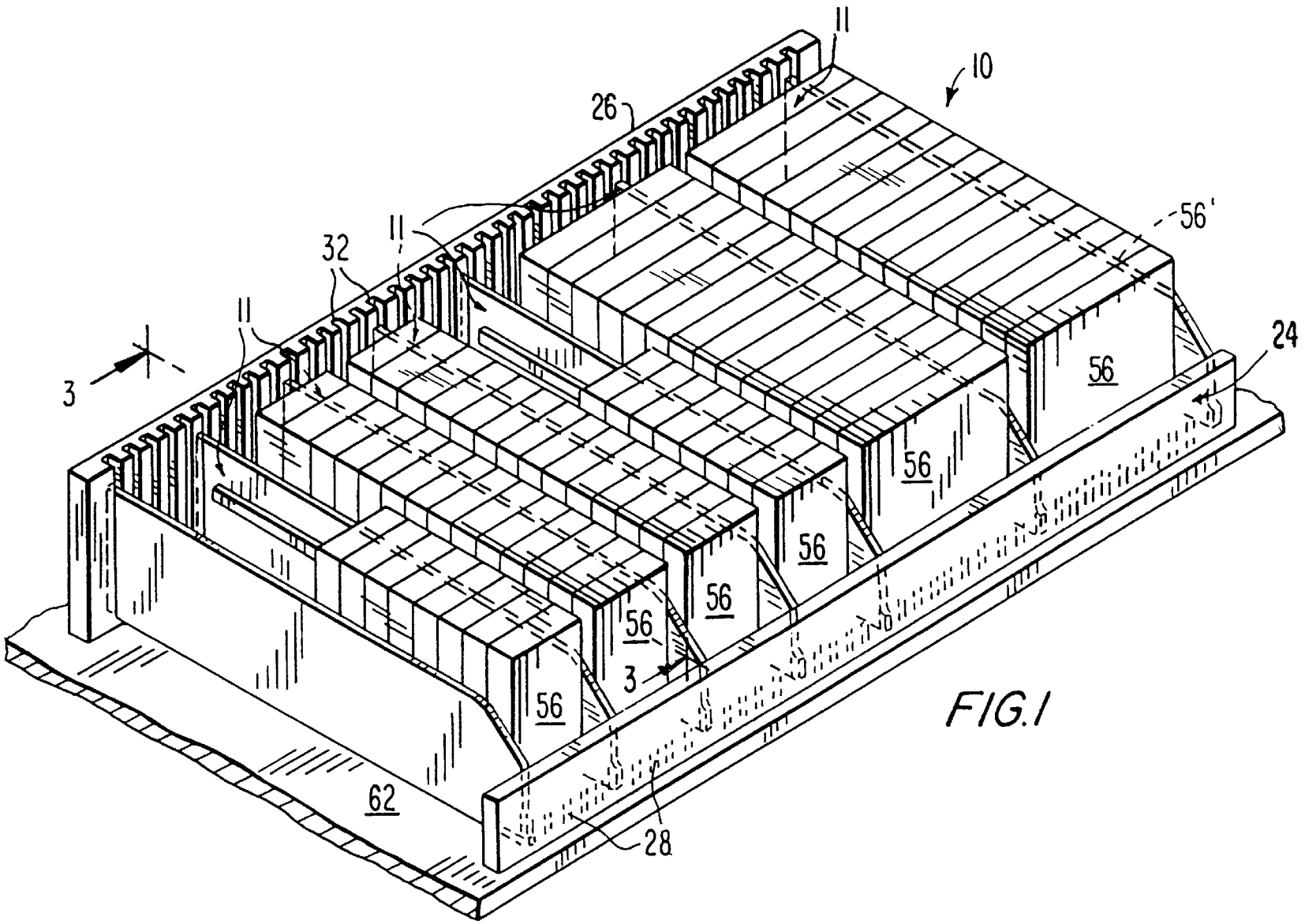
FIG. 1 is a perspective view of the display device showing a first embodiment of the invention.

A display device 10 is shown in FIGS. 1 through 19. The display device 10 is typically mounted on a shelving unit 62. The display device can also be connected to the shelving unit 62 by connectors, such as screws, clips or pins. It is understood that the display device 10 can be mounted to any number of different shelving systems, and that the display device 10 can include an integral shelving unit 62, so that the display device 10 can be easily placed on a surface such as a counter. It is also possible to combine a plurality of the display devices 10 to form a larger arrangement. For purposes of illustration, FIGS. 1 through 5 depict a first embodiment of the invention wherein the display device 10 is mounted on an existing shelving unit 62, and in which a product 56 is arranged.

Figure 2:
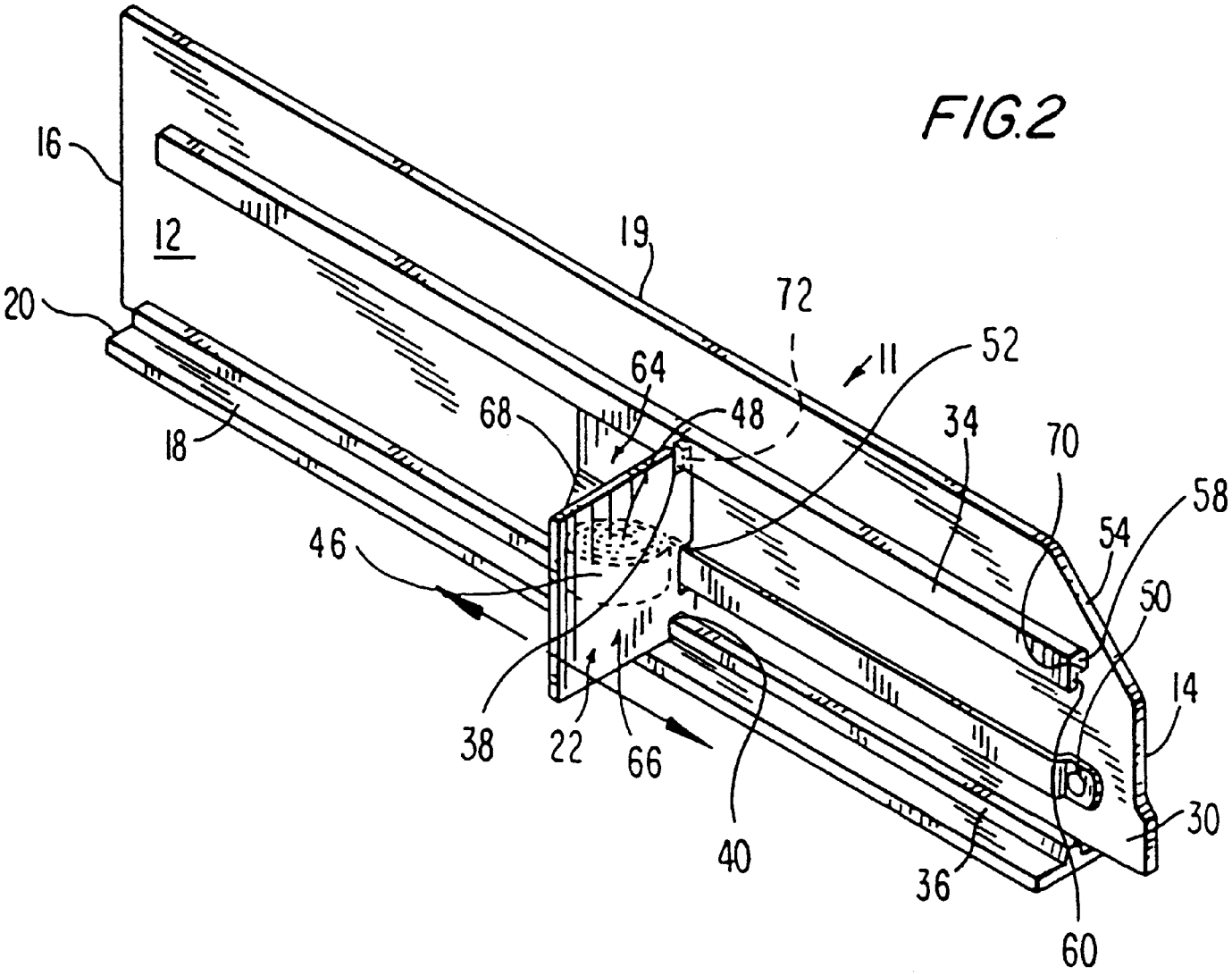
FIG. 2 is a perspective view of a divider member of the first embodiment removed from the display device.

Referring to FIGS. 1 and 2, the display device 10 comprises at least one divider member 11 having a pusher plate 22 movably connected thereto. The divider member 11 is removably supported between a first support member 24 and a second support member 26. The divider member 11, the pusher plate 22 and the support members 24, 26 are made of a plastic material, although other suitable materials such as metal or wood may also be used.

Figure 3:
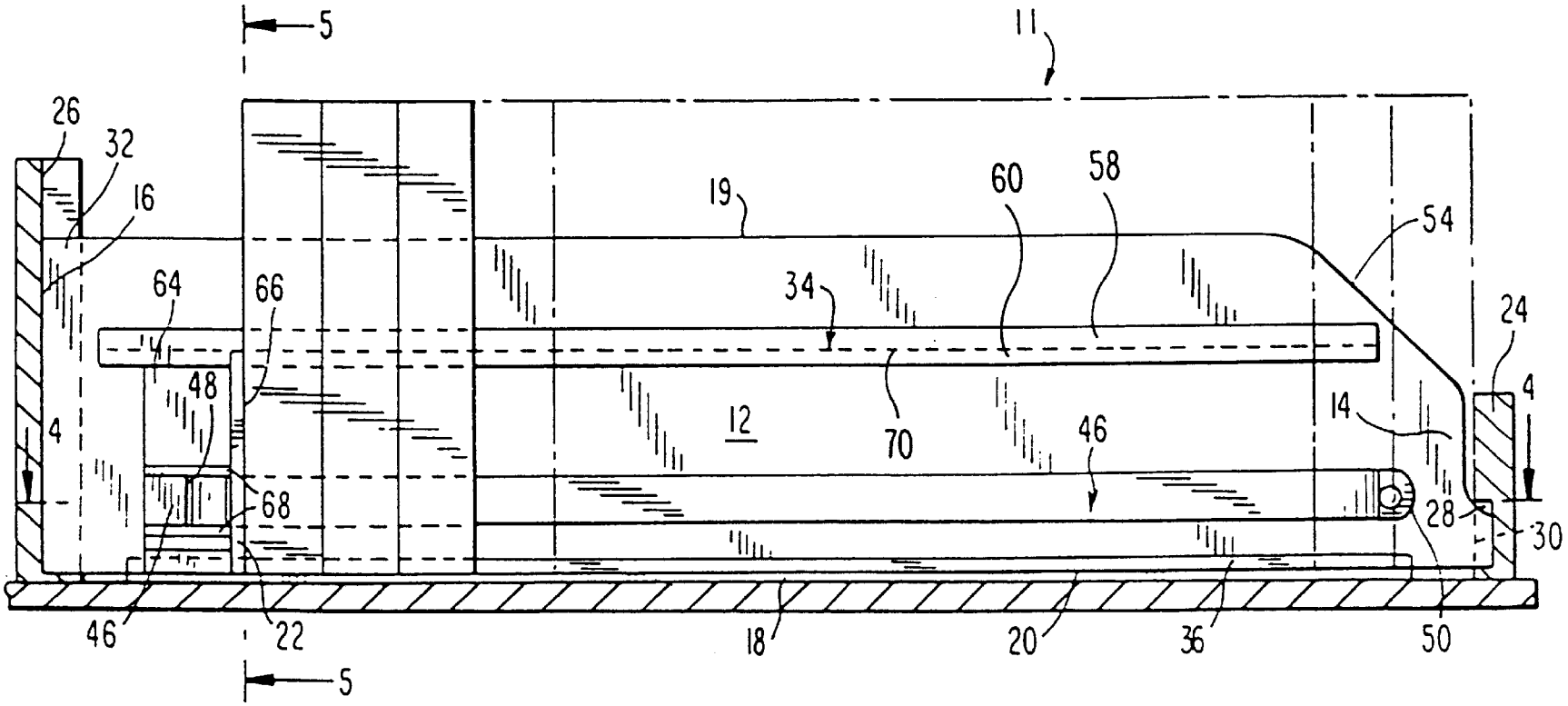
FIG. 3 is an elevational view of the divider member as taken along lines 3—3 of FIG. 1.

As shown in FIGS. 2 and 3, the at least one divider member 11 includes a web 12 and a flange 20. The web 12 has a first end 14, a second end 16, a first edge 18 and a second edge 19. The flange 20 is affixed to the first edge 18 so as to be perpendicular to the web, and serves as a track to facilitate movement of the product 56. When a plurality of divider members 11 is used, the product 56 is placed between any of two adjacent divider members 11, the product 56 thereby slidably resting on the flanges 20 of both adjacent divider members 11.

A first guide rail 34 is attached to a side of the web 12, extends from proximal the first end 14 to proximal the second end 16 and is parallel to the two edges 18, 19. The first guide rail 34 has an L-shaped cross section, with a first leg 58 fixed to the side of the web 12, and a second leg 60 extending towards the flange 20. The second leg 60 is perpendicular to the first leg 58 so that the second leg 60 is parallel to the web 12 thereby defining a channel 70. The pusher plate 22 has a first notch 38 in its top edge that forms a tab 72 that is engageable in the channel 70 behind the second leg 60 of the guide rail 34. Additionally, a second guide rail 36 is attached to a side of the flange 20 proximal the side of the web 12 to which the first guide rail 34 is attached. The second guide rail 36 also extends between regions proximal the two ends 14, 16, and is parallel to the first edge 18. The second guide rail 36 has a rectangular cross section, and the pusher plate 22 has a second notch 40 formed to slide along the second guide rail 36. The guide rails 34, 36 can also be of any of a variety of cross sections wherein the notches 38, 40 are formed in the pusher plate 22 to correspond to the respective guide rail cross sections. Furthermore, other arrangements of the guide rails or guide slots can be used to restrain the pusher plate 22, as described in greater detail below (FIGS. 6 through 13).

Returning to FIGS. 3 and 4, the pusher plate 22 has an L-shaped cross-section having a guide leg 64 positioned parallel to the web so as to be movably engaged in the guide rails 34, 36. A pusher leg 66 is attached perpendicular to the guide leg 64, the pusher leg 66 thereby extending perpendicularly from the web 12. Two brackets or webs 68 are perpendicularly connected between the two legs 64, 66. The brackets 68 are parallel to the flange 20 and to each other and are spaced apart by a distance. The brackets 68 are attached to a side of the pusher plate 22 facing the second end 16.

A flat coil spring 46 has a coil end 48 and a free end 50. The coil end 48 is inserted between the brackets 68 and the free end 50 is fixed to the web proximal the first end 14, thereby biasing the pusher plate 22 towards the first support member 24. A third notch 52 is arranged in the pusher plate 22 to allow the pusher plate 22 to pass over the coil spring 46 as the pusher plate 22 moves along the guide rails 34, 36. Alternatively, coil spring 46 can be replaced by any other suitable known device having elastic properties such that pusher plate 22 is biased towards the first support member 24. In the embodiment disclosed, coil spring 46 biases pusher plate 22 toward the first support member 24 by pulling pusher plate. It is contemplated in another embodiment to provide another alternative spring that can push pusher plate 22 toward the first support member 24. Examples of such alternative springs are schematically show in FIGS. 18 and 19, and can be one or more springs 124 coupled to a rear end of the divider and the pusher plate 22 such that pusher plate 22 is pushed toward front end 14 (i.e., toward the left in FIG. 18). Springs 124 are selected such that their spring coefficient enables the biasing of pusher plate 22 as described. In another alternative embodiment shown in FIG. 19, coil spring 46 can be replaced with elastic bands 122*a* and 122*b* connected at one end to the front of pusher plate 22, and at the other end to the front 14 of divider 11. Alternatively, the bands 122*a* and 122*b* can pass through divider 11 in an area adjacent front 14 and be connected on the opposing side of divider 11. In each alternative spring connection, the biasing spring device is positioned so as not to interfere with the desired pushing of the products within the display. Bands 122*a* and 122*b* can be replaced with pulled out or extended springs without departing from the scope of this disclosure.

Figure 4:
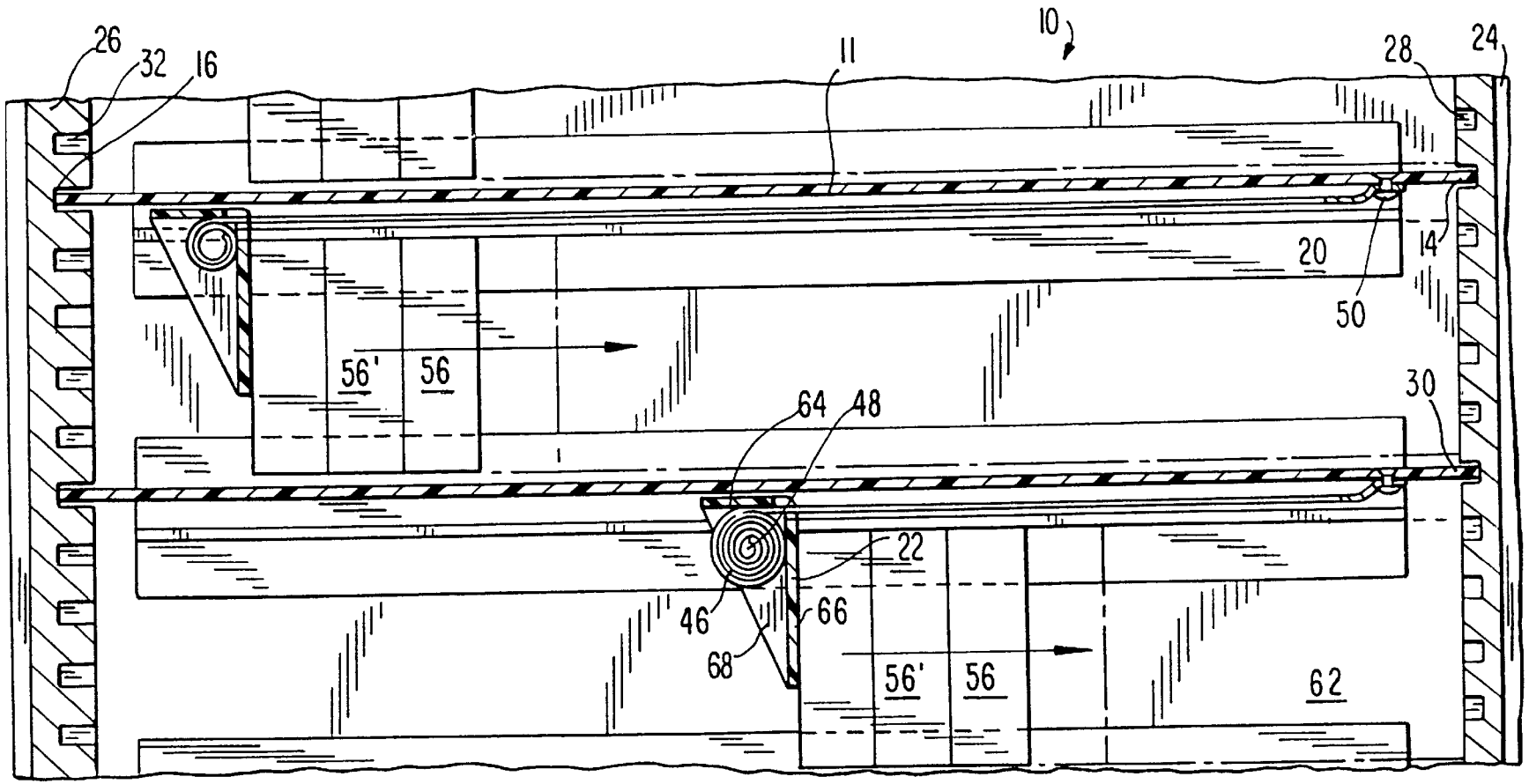
FIG. 4 is a plan view of the of the first embodiment showing a detail with two of the divider members in position.
Figure 5:
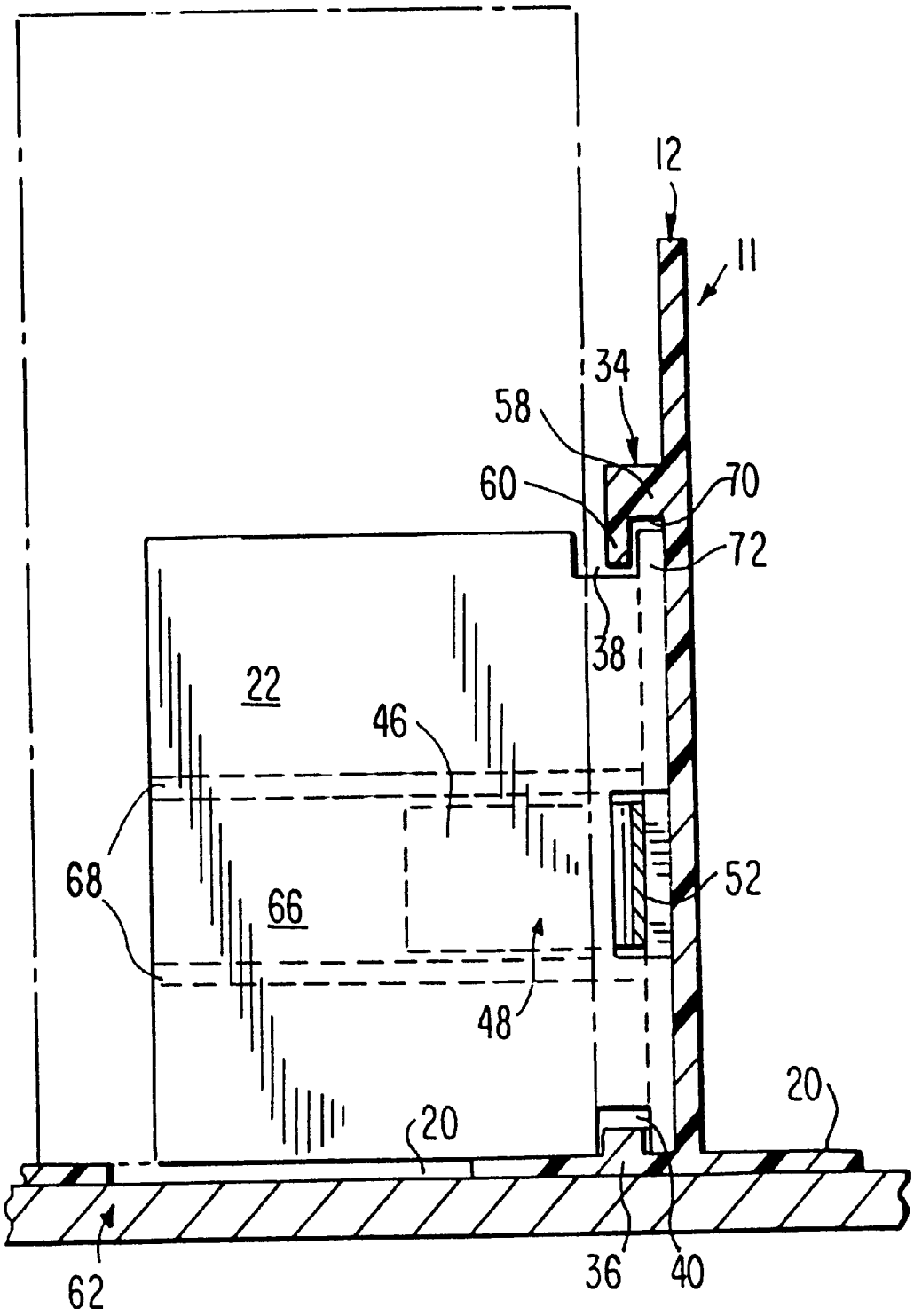
FIG. 5 is a sectional view of the pusher as taken along lines 5—5 of FIG. 3.

As can be seen in FIGS. 3, 4 and 5, a support tab 30 extends from the first end 14, and is removably insertable into one of a plurality of depressions 28 arranged in the web side of the first support member 24. The second end 16 is removably inserted into one of a plurality of support slots 32 arranged in the web side of the second support member 26. Spring clips can also be utilized to removably insert the at least one divider member 11 into the support members 24, 26.

An advantage of the present invention is that the pusher plate 22, the coil spring 46 and the guide rails 34, 36, are all attached to the divider member 11, so that it is easy to rearrange the divider member, the pusher plate 22 and the coil spring 46 to accommodate various sizes of the product 56. Another advantage is that the web 12 has a cut-away portion, such as a taper 54 extending from the second edge 19 to the first end 14, to facilitate access for removing the product 56 from the display device 10.

To position the divider member 11, the support tab 30 of the first end 14 is removably inserted into the at least one depression 28 of the first support member 24, next the second end 16 is removably inserted into a corresponding support slot 32 of the second support member 26. This process being repeated for each divider member 11 used.

Figures 10, 11:
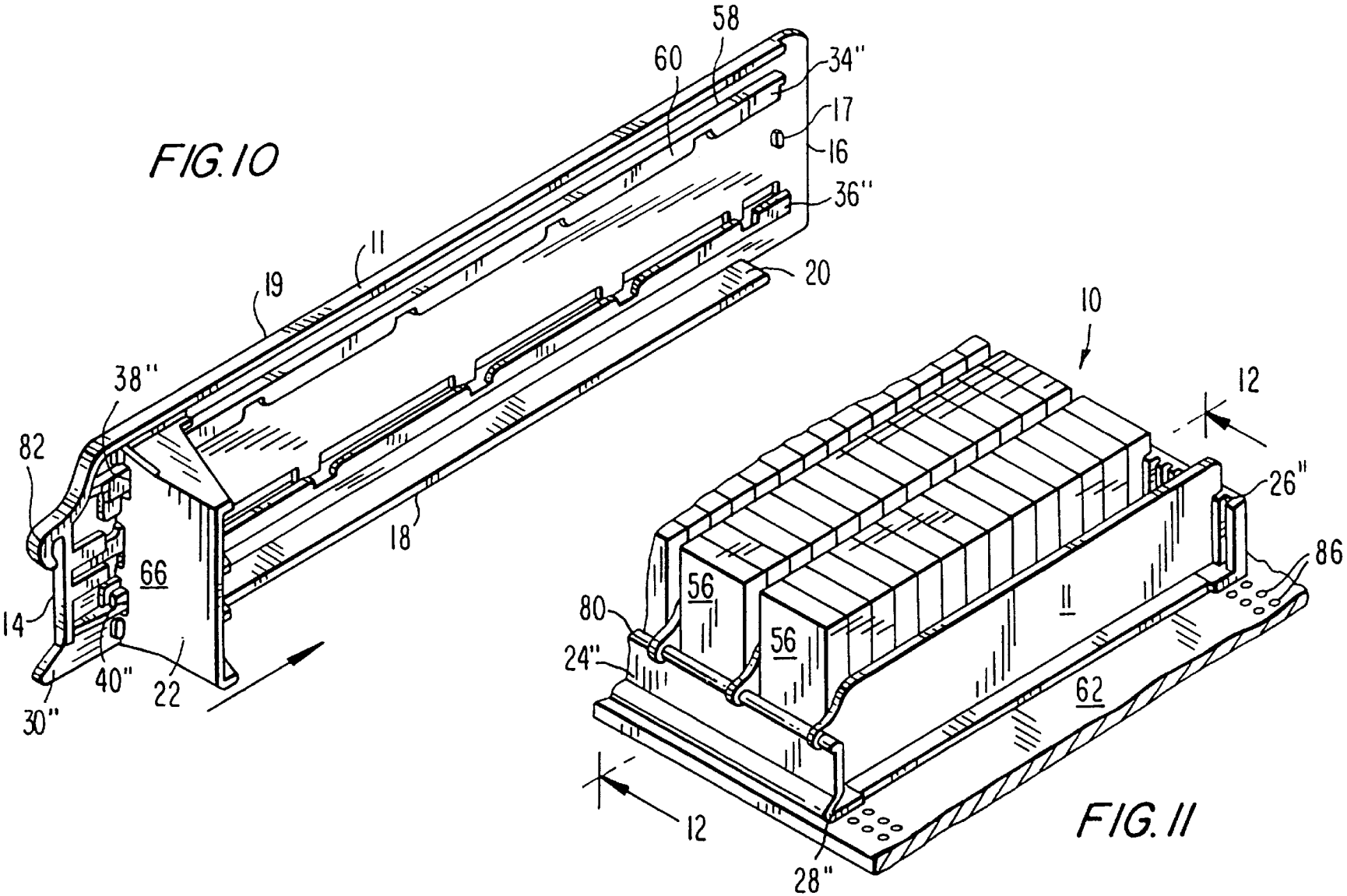
FIG. 10 is a perspective view of a divider member of a fourth embodiment removed from the display device.
FIG. 11 is a perspective view of the display device showing the fourth embodiment of the invention.
Figures 12, 13:
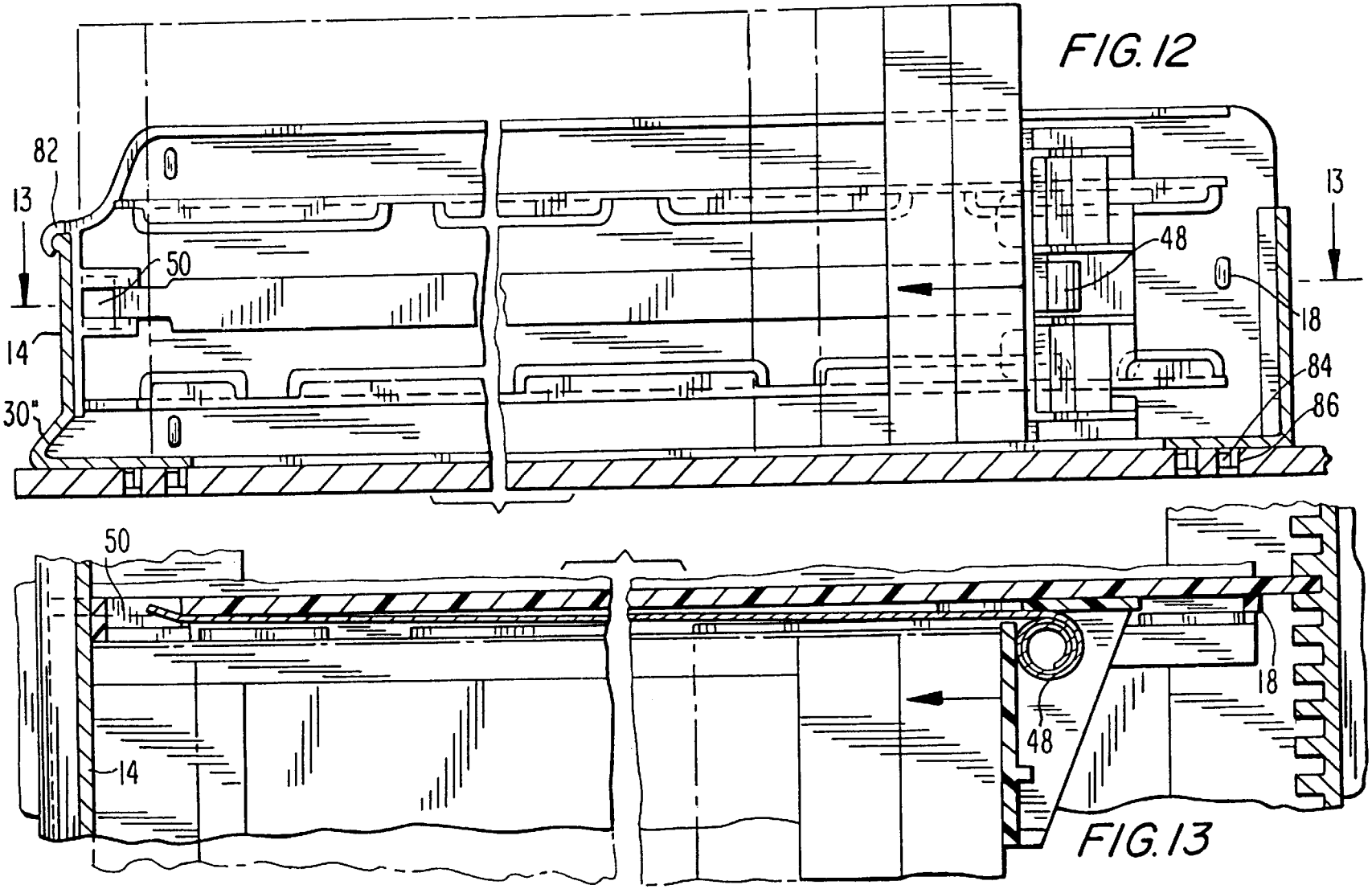
FIG. 12 is an elevational view of the divider member as taken along lines 12—12 of FIG. 11.
FIG. 13 is a sectional view of the divide member as taken along lines 13—13 of FIG. 12.

When the display device 10 is empty, the flat coil spring 46 disposes the pusher plate 22 toward the first end 14 proximal to the first support member 24. The display device 10 is loaded by urging the product 56 against the pusher plate 22 towards the second support member 26, the product 56 being placed between the pusher plate 22 and the first support member 24 until the product 56 rests on or adjacent the flange 20. When the product 56 is thus loaded (as shown in FIGS. 1, 4 and 11), the tension of the coil spring 46 biases the pusher plate 22, and thereby the product 56, towards the first support member 24 which also acts as a stop. Typically a plurality of the product 56 is loaded in this fashion so that stock is systematically rotated toward the first support member 24. It is also possible to attach a descriptive label or illustration to the first support member 24 to aid in identification and selection of the product 56.

Once the product 56 is selected, it is grasped near the taper 54 of the web 12 and simply removed from the display device 10. The tension of the coil spring 46 biases the pusher plate 22 towards the first support member 24 until the next product 56' contacts the first support member 24. In this manner, each time the product 56 is removed, the next product 56' is disposed to the first support member 24. The display device 10 therefore has the advantages of dispensing the product, systematically rotating stock and presenting the product 56 in a neat, organized and attractive manner.

FIGS. 6 and 7 illustrate a second embodiment of the present invention wherein, the guide rails 34, 36 are replaced by at least one guide slot 42, and the first and second notches 38, 40 are replaced by at least one guide tab 44 arranged on the pusher plate 22. The at least one guide tab 44 slidably engages the at least one guide slot 42. It is also possible to use guide rails and guide slots together.

Figure 8:
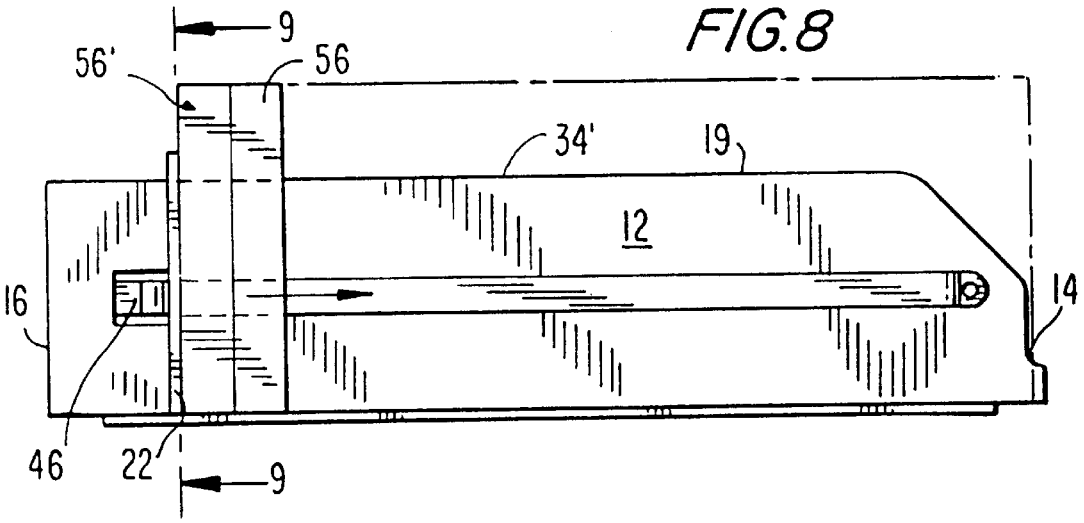
FIG. 8 is an elevational view of the divider member of a third embodiment of the invention.
Figure 9:
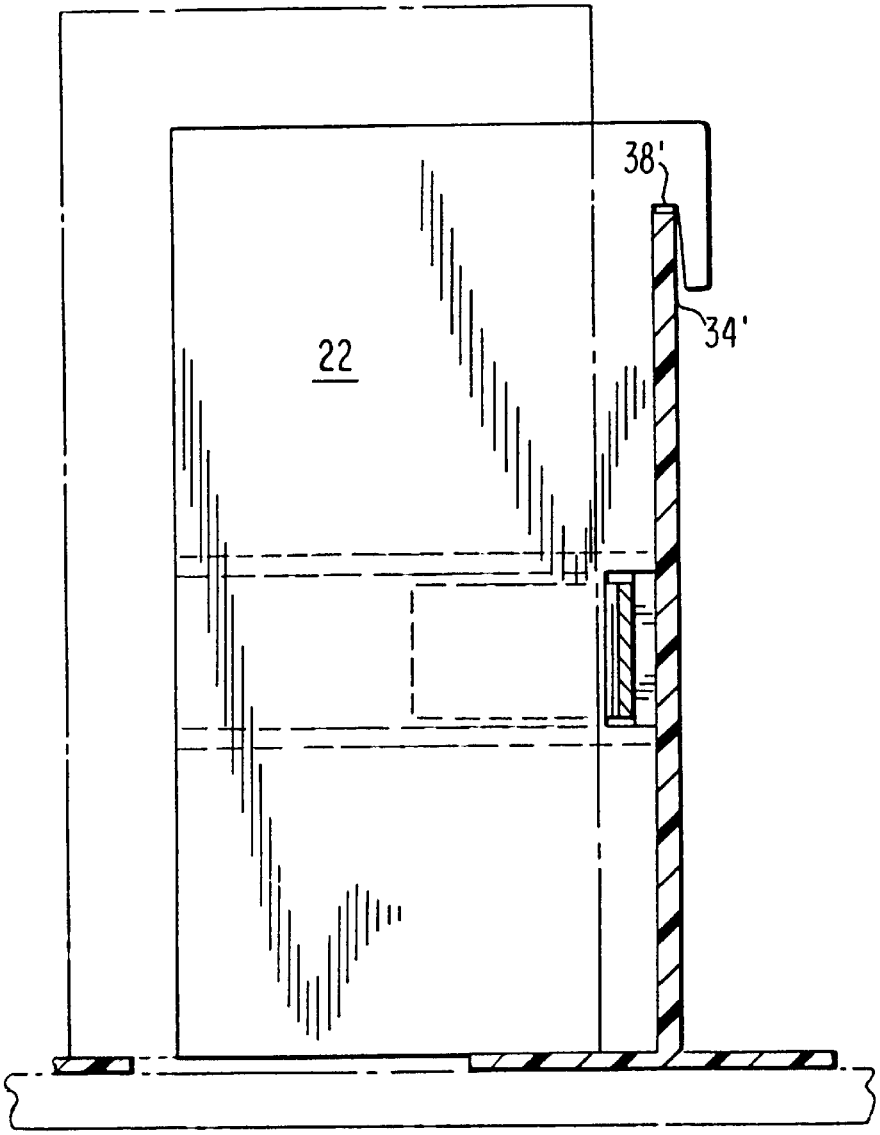
FIG. 9 is a sectional view of the pusher plate taken along lines 9—9 of FIG. 8.

FIGS. 8 and 9 show a third embodiment of the present invention wherein the first guide rail 34' is arranged along the second edge 19 of the web 12. The first guide notch 38' is configured to slidably engage the first guide rail 34'. Additional guide rails or guide slots can also be incorporated into this embodiment.

A fourth embodiment of the present invention is shown in FIGS. 10–13. The first guide rail 34" is attached to a side of the web 12 and the second guide rail 36" is attached to the same side of the web 12 as the first guide rail 34". The second guide rail 36" is inverted with relation to the first guide rail 34" so the second leg 60 extends away from the flange. The first and second guide notches 38", 40" are configured to slideably engage the respective first and second guide rails 34", 36". Web 12 includes a raised button 17 which acts as a stop for preventing pusher plate 22 from being pushed beyond the rear end 16 of web 12 and becoming disengaged from guide rails 34" and 36". Although several embodiments for guide rails 34 and/or 36 have been shown, it is understood that any suitable known type of guide system may also be incorporated into the display system without departing from the scope of this disclosure.

The tab 30" of the web 12 is configured to removably engage the depression 28" configured in the first support member 24", the depression 28" forming a bulge on the side of the first support member 24" facing the user. A lip 80 is arranged on an edge of the first support member 24" and a corresponding hook 82 is formed on the web first end 14 to removable engage the lip 80. Furthermore, a plurality of pins 84 are disposed along the edges of the support members 24", 26" facing the shelf 62. The pins 84 are arranged to removably engage corresponding openings 86 configured in the shelf 62, such as in a typical shelf for a standard merchandising gondola.

Figure 14:
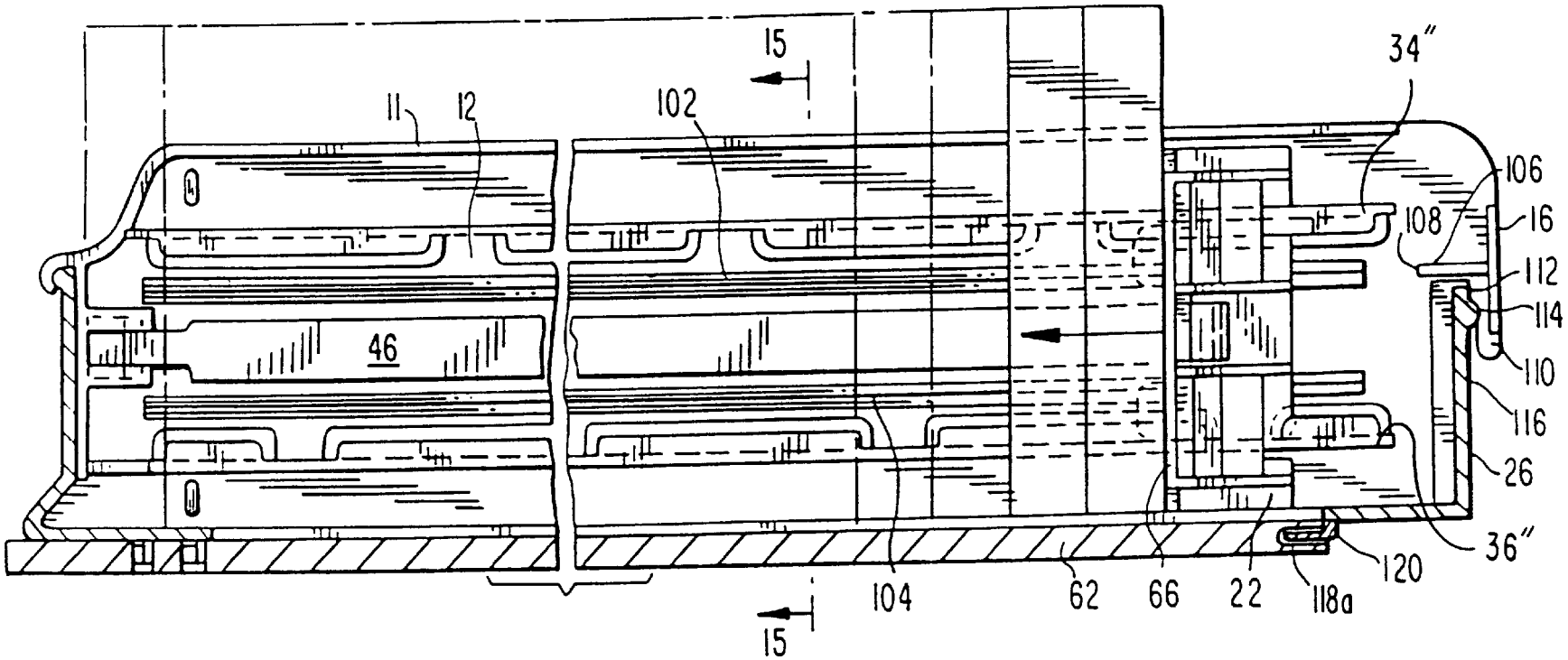
FIG. 14 is an elevational view of the divider member according to another embodiment of the present invention.

Referring to FIGS. 14 and 15, there is shown another embodiment of the divider 11 according to the present invention. In this embodiment, divider 11 includes bevels 102 and 104 disposed on web 12 and arranged adjacent to the respective guide rails 34" and 36". Bevels 102 and 104 can be mounted on web 12 and are preferably integrally formed therewith. Bevels 102 and 104 extend outward such that their respective heights $h_3$ and $h_1$ are substantially equal to the heights $h_2$ of guide rails 34" and 36", respectively. In a preferred embodiment, the height $h_1$ of bevel 104 is equal to the height $h_2$ of the guide rails. The height $h_3$ of bevel 102 does not have to equal that of height $h_2$ but cannot exceed the same. When products 56 are boxes, sometimes these boxes have flaps that come free during shipping. The loose flaps can interfere with the smooth operation of the pushing mechanism by getting caught on guide rails 34" and/or 36". During operation, bevels 102 and 104 prevent the products 56 from getting caught on guide rails 34" and 36" while loading and using the display system. Bevels 102 and 104 are shown, for example, as having a triangular cross-section. With the inclusion of bevels 102 and 104, corresponding notches are also incorporated in pusher plate 22 to accommodate said bevels. It is understood that the shape of bevels 102 and 104 can be any suitable shape, such as rectangular or square in cross-section, provided their heights are in accordance with the present disclosure. Although two bevels are shown, alternatively one or more than two bevels may be used.

As shown in FIG. 14, the end 16 of divider 11 includes a hook-like engagement flange 110 forming an opening 112 at end 16. The second support member 26 includes a protrusion or lip 116 extending outward from a rear side thereof such that lip 116 engages a notch 114 in flange 110 so as to secure second support member 26 in a fixed position relative to shelf 62. As shown in FIGS. 14, and 16–17*b*, second support member 26 includes engagement hooks 120 preferably integrally formed therewith, for engaging holes 118*a*–118*c* on a rear edge of shelf 62. Thus, when the front 14 of divider 11 is mounted on first support member 24 as shown in FIGS. 10–13, the hook-like engagement flange 110 engages lip 116 and thereby secures the second support member 26 to the first support member 24 which prevents second support member 26 from being displaced out of its engagement with holes 118*a–c* via engagement hooks 120. The lip 116 on second support member 26 and the notch 114 on flange 110 are optional and are not required for causing the engagement between opening 112 and the upper end of second support member 26. Opening 112 can frictionally fit over the upper end of second support member 26 and thereby eliminate any need for lip 116 and corresponding notch 114.

In the embodiment of FIG. 14, raised button 17 (shown in FIG. 10) is eliminated and replaced by a raised rib 106 extending substantially perpendicular to the pusher 22. A stop face 108 of raised rib 106 engages prevents pusher 22 from being disengaged from guide rails 34" and 36" by engaging a back side of pusher 22 when said pusher is pushed toward the rear end 16 of divider 11. Raised rib 106 also provides additional integrity to the hook-like engagement flange 110 formed on the end 16 of divider 11.

The invention is not limited by the embodiments described above which are presented as examples only but can be modified in various ways within the scope of protection defined by the appended patent claims.

We claim:

1. A display device, comprising:

at least one divider member, the at least one divider member including a web having a first end, a second end and a first edge extending between the first end and the second end, the at least one divider member further including a flange mounted to the first edge so as to be at an angle to the web;

a pusher plate slidably attached to the web; a spring for biasing the pusher plate to one of the ends of the web;

means for guiding the pusher plate so as to move between the first end and the second end, the guiding means extending from proximal the first end of the web to proximal the second end of the web; and a first support member and a second support member, the first end of the web being removably mounted to the first support member, and the second end of the web being removably mounted to the second support member;

wherein the second support member includes at least one member extending from an underside of said second support member and being adapted to position said second support member, said member adapted to engage a correspondingly positioned hole in an edge of a shelf on which said display device is disposed.

2. The display device in accordance with claim 1, wherein the web lies in a plane and the first support member is parallel to the second support member, both the first support member and the second support member being positioned perpendicular to the plane of the web.

3. The display device in accordance with claim 1, wherein the second support member comprises at least one support slot in a side of the second support member facing the second end of the web so that the second end of the web is removably insertable therein.

4. The display device in accordance with claim 1, wherein the web has a second edge extending between the first end and the second end, the second edge being tapered toward the first edge near the first end so as to facilitate access to a product.

5. The display device in accordance with claim 1, wherein the web and the flange are formed as a unitary element.

6. The display device in accordance with claim 1, wherein a plurality of the at least one divider member is provided, the support members being configured to removably support the plurality of the at least one divider member.

7. The display device in accordance with claim 1, wherein the flange is mounted perpendicular to the web so that the web and the flange form an inverted T-shaped cross section.

8. The display device in accordance with claim 1, wherein the first support member further comprises at least one pin provided at a side thereof.

9. The display device in accordance with claim 1, wherein the second support member further comprises at least on pin provided at a side thereof.

10. The display device in accordance with claim 1, wherein the first support member has at least one depression in a side of the first support member facing the first end of the web.

11. The display device in accordance with claim 10, wherein the web further comprises a support tab provided at the first end and configured so as to be removably insertable into the at least one depression of the first support member.

12. The display device in accordance with claim 1, wherein the guiding means comprises at least one guide slot configured in at least one of the web and the flange.

13. The display device in accordance with claim 12, wherein the pusher plate comprises at least one guide tab arranged in the at least one guide slot so as to be moveable between the first end and the second end of the web.

14. The display device in accordance with claim 1, wherein said spring comprises a flat coil spring having a coil end mounted to the pusher plate and a free end fixed to the web.

15. The display device in accordance with claim 14, wherein the pusher plate has a notch configured so as to permit the flat coil spring to pass through the pusher plate.

16. The display device in accordance with claim 14, wherein the pusher plate is configured to have an L-shaped cross-section with a guide leg parallel to the web and slidably engaged in the guide means, and a pusher leg attached to the guide leg and being perpendicular thereto so that the pusher leg extends perpendicularly from the web, two brackets being arranged to extend between the guide leg and the pusher leg, the two brackets being parallel to each other and spaced apart from one another, the coil end of the flat coil spring being arranged between the two brackets.

17. The display device in accordance with claim 1, wherein the first support member comprises a lip provided at one edge.

18. The display device in accordance with claim 17 wherein the web filter comprises a hook provided at the first end and configured so as to be removably engageable with the lip of the first support member.

19. The display device in accordance with claim 1, wherein said spring is configured to pull said pusher plate toward one of the ends of said web.

20. The display device in accordance with claim 19, wherein said spring comprises an elastic band having one end coupled to said pusher plate and a second end coupled to said first end of said web.

21. The display device in accordance with claim 1, wherein said spring is configured to push said pusher plate toward one of the ends of said web.

22. The display device in accordance with claim 21, wherein said spring comprises one end coupled to a rear side of said pusher plate and a second end coupled to said second end of said web.

23. The display device in accordance with claim 1, wherein said at least one divider further comprises an engagement flange disposed on said second end of said web for enabling the removable mounting of said second end to said second support member, said engagement flange connecting said second support member with said first support member via said at least one divider.

24. The display device in accordance with claim 23, wherein said second support member comprises an upper edge having a lip and said engagement flange comprises a notch releasably receiving said lip when said engagement flange is disposed in operable connection with said second support member.

25. The display device in accordance with claim 1, further comprising a stopper formed on said web proximal to said second end and adapted to prevent said pusher plate from being disengage from said guiding means.

26. The display device in accordance with claim 25, wherein said stopper comprises a raised button integrally formed on said web.

27. The display device in accordance with claim 25, wherein said stopper comprises a raised rib disposed perpendicular to said pusher plate and having a stop face.

28. The display device in accordance with claim 1, further comprising a bevel disposed on said web for providing support to an object being acted upon by said pusher plate.

29. The display device in accordance with claim 28, wherein said at least one bevel is disposed adjacent said guiding means.

30. The display device in accordance with claim 1, wherein the guiding means comprises a first guide rail attached to the web.

31. The display device in accordance with claim 30, wherein the web has a second edge extending between the first end and the second end, the first guide rail being provided at the second edge, the pusher plate having a first notch configured to slidably engage the first guide rail.

32. The display device in accordance with claim 30, wherein the guiding means further comprises a second guide rail attached to the web.

33. The display device in accordance with claim 32, wherein the pusher plate further comprises a first notch that corresponds to the first guide rail.

34. The display device in accordance with claim 33, wherein the pusher plate further comprises a second notch that corresponds to the second guide rail.

35. The display device in accordance with claim 34, wherein the second guide rail has an L-shaped cross section, with a first leg attached to the web and a second leg arranged to project into the second notch.

36. The display device in accordance with claim 30, wherein the guiding means comprises a second guide rail attached to the flange.

37. The display device in accordance with claim 36, wherein the second guide rail has a rectangular cross section.

38. The display device in accordance with claim 36, wherein the pusher plate comprises a first notch that corresponds to the first guide rail.

39. The display device in accordance with claim 38, wherein the first guide rail has an L-shaped cross section, with a first leg attached to the web and a second leg arranged to project into the first notch.

40. The display device in accordance with claim 38, wherein the pusher plate comprises a second notch that corresponds to the second guide rail.

* * * * *